United States Patent [19]

Pokladnik et al.

[11] 4,438,817

[45] Mar. 27, 1984

[54] SUBSEA WELL WITH RETRIEVABLE PIPING DECK

[75] Inventors: Roger L. Pokladnik, Houston; William A. Valka, Spring, both of Tex.

[73] Assignee: Armco Inc., Middletown, Ohio

[21] Appl. No.: 426,695

[22] Filed: Sep. 29, 1982

[51] Int. Cl.[3] ..... E21B 43/01

[52] U.S. Cl. ..... 166/341; 166/344; 166/357; 166/366; 166/368

[58] Field of Search ..... 166/341, 339, 344–347, 166/351, 357, 362, 366, 368

[56] References Cited

U.S. PATENT DOCUMENTS

| | | | |
|---|---|---|---|
| 3,633,667 | 1/1972 | Falkner, Jr. | 166/366 |
| 3,777,812 | 12/1973 | Burkhardt et al. | 166/366 X |
| 3,877,520 | 4/1975 | Putnam | 166/366 |
| 3,881,549 | 5/1975 | Thomas | 166/357 |
| 3,987,638 | 10/1976 | Burkhardt et al. | 61/88 |
| 4,036,295 | 7/1977 | Kirkland et al. | 166/342 |
| 4,120,362 | 10/1978 | Chateau et al. | 166/339 |
| 4,192,383 | 3/1980 | Kirkland et al. | 166/341 |
| 4,194,857 | 3/1980 | Chateau et al. | 405/203 |
| 4,286,665 | 9/1981 | Walker | 166/366 X |

*Primary Examiner*—James A. Leppink
*Assistant Examiner*—Thuy M. Bui
*Attorney, Agent, or Firm*—Roylance, Abrams, Berdo & Goodman

[57] ABSTRACT

An apparatus and method for drilling and completing a subsea well located at the seabed using a retrievable piping deck. The apparatus includes a template supported on the seabed, the retrievable piping deck supported on the template, a plurality of wellheads supported on the template and a plurality of Christmas trees supported on the wellheads. The piping deck has preinstalled flow lines and hydraulic lines to conduct well fluid from the Christmas trees to the surface and to conduct hydraulic control fluid from the surface to the trees. In addition to the Christmas trees, a well fluid manifold and a gaseous-liquid component separator can be supported on the template. The fluid connections between the Christmas trees and the hydraulic and flow lines and between the manifold and separator and the hydraulic and flow lines are accomplished by vertically oriented stab-in connectors. After installation of the template and drilling of the wells, the piping deck is lowered independently to the template and coupled thereto and then the Christmas trees and manifold-separator are lowered to the template and into fluid communication with the piping deck hydraulic and flow lines.

12 Claims, 4 Drawing Figures

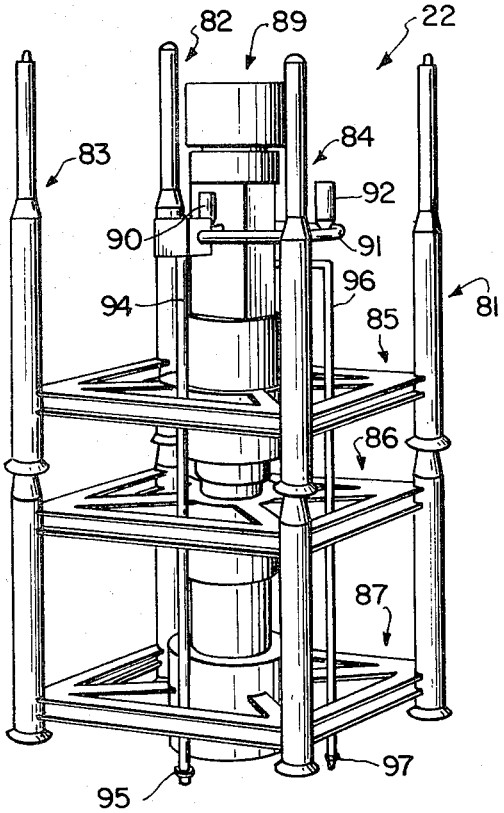
FIG. 3
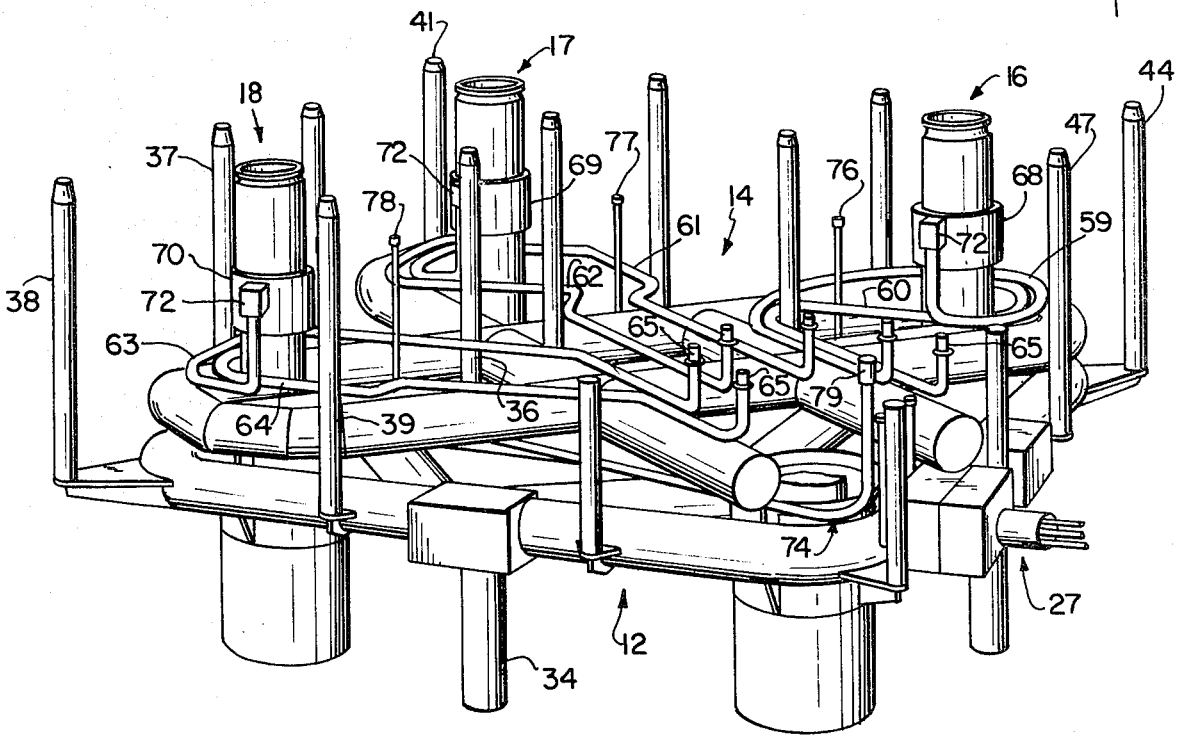

SUBSEA WELL WITH RETRIEVABLE PIPING DECK

FIELD OF THE INVENTION

The invention relates to a subsea well located at the seabed having a retrievable piping deck. This piping deck has preinstalled flow lines and hydraulic lines to conduct well fluid from Christmas trees located on the template to the surface and to conduct hydraulic fluid from the surface to the Christmas trees. After installation of the template and drilling of a plurality of wells therethrough, the piping deck is lowered independently to the template and coupled thereto and then the Christmas trees are lowered to the template and into fluid communication with the piping deck flow lines and hydraulic lines.

BACKGROUND OF THE INVENTION

Traditionally, subsea wells located on the seabed comprised well casing extending into the earth, a wellhead coupled to the casing and located at the seabed, a valving system commonly known as a Christmas tree coupled to the wellhead, and a flowline extending from the Christmas tree to the surface. In more recent times, templates have been used which are located on the seabed and which can support a plurality of Christmas trees and wellheads communicating with a plurality of wells. Typically, these templates are pre-piped to provide flow line and hydraulic line interconnection between the Christmas trees supported on the template. Unfortunately, if these hydraulic and flow lines on the template are damaged and the template is below diver depth, the entire subsea production system has to be shut down permanently Such damage to these lines can occur due to earthquakes, equipment falling from surface vessels and the like.

Accordingly, it is highly advantageous to arrange such a subsea well system in which the hydraulic and flow lines used with the Christmas trees can be retrieved. While this is broadly known in the prior art, the prior art attempts have not met with considerable success since they are complicated and usually need diver intervention.

Examples of these prior art devices are disclosed in the following U.S. Pat. Nos.: 3,633,667 to Falkner, Jr.; 3,777,812 to Burkhardt et al.; 3,877,520 to Putnam; 3,881,549 to Thomas; 3,987,638 to Burkhardt et al.; 4,036,295 to Kirkland et al.; 4,120,362 to Chateau et al.; 4,192,383 to Kirkland et al.; and 4,194,857 to Chateau et al.

Accordingly, there is a continuing need for improvement in such well systems.

SUMMARY OF THE INVENTION

Accordingly, a primary object of the invention is to provide a subsea well with a retrievable piping deck that can be retrieved for repairs.

Another object of the invention is to provide such a well wherein the hydraulic and flow lines on the piping deck can be preinstalled for ease of construction and pressure tested before installation.

Another object of the invention is to provide a method for drilling and completing a subsea well using a retrievable piping deck.

Another object of the invention is to provide an apparatus for a subsea well that includes a retrievable piping deck that is uncomplicated to construct and install and requires no diver intervention.

The foregoing objects are basically attained by providing a subsea well, the combination comprising a template installed on the seabed and having a plurality of guide sleeves oriented over a plurality of wells formed in the seabed; a plurality of wellheads, each installed in one of the guide sleeves; a retrievable piping deck having a plurality of flow lines coupled thereto and located on the top of the template; a plurality of Christmas trees, each installed on one of the wellheads; a mechanism, including vertically oriented connectors, for coupling each of the Christmas trees to one of the flow lines; a fluid manifold installed on the template; a mechanism, including vertically oriented connectors, for coupling each of the flow lines to the manifold; and a main flow line coupled to the manifold and extending from the template to the surface of the sea.

Advantageously, the piping deck also includes hydraulic lines and vertically oriented connectors to connect the Christmas trees and the manifold to control valves in the Christmas tree, these hydraulic lines having a connection with the surface. In addition to the fluid manifold, a separator for separating the gaseous and liquid components of the well fluid can be incorporated with the manifold.

The foregoing objects are also basically attained by a method of drilling and completing a subsea well comprising the steps of lowering a template to the seabed, drilling a plurality of wells in the seabed through the template, lowering a plurality of wellheads to the template and installing the wellheads over the wells, lowering a retrievable piping deck onto the template, the piping deck carrying flow lines with upwardly facing connectors thereon, lowering a plurality of Christmas trees to the template, each having a flow line with a downwardly facing connector thereon, coupling the piping deck flow lines and Christmas tree flow lines via their connectors by downward movement of the Christmas trees onto the wellheads, and conducting well fluid from the wells, through the wellheads, through the Christmas trees, and through the connected Christmas tree and piping deck flow lines to the surface of the sea.

Other objects, advantages and salient features of the invention will become apparent from the following detailed description which, taken in conjunction with the annexed drawings, discloses a preferred embodiment of the invention.

DRAWINGS

Referring now to the drawings which form a part of this original disclosure:

Figure 2:
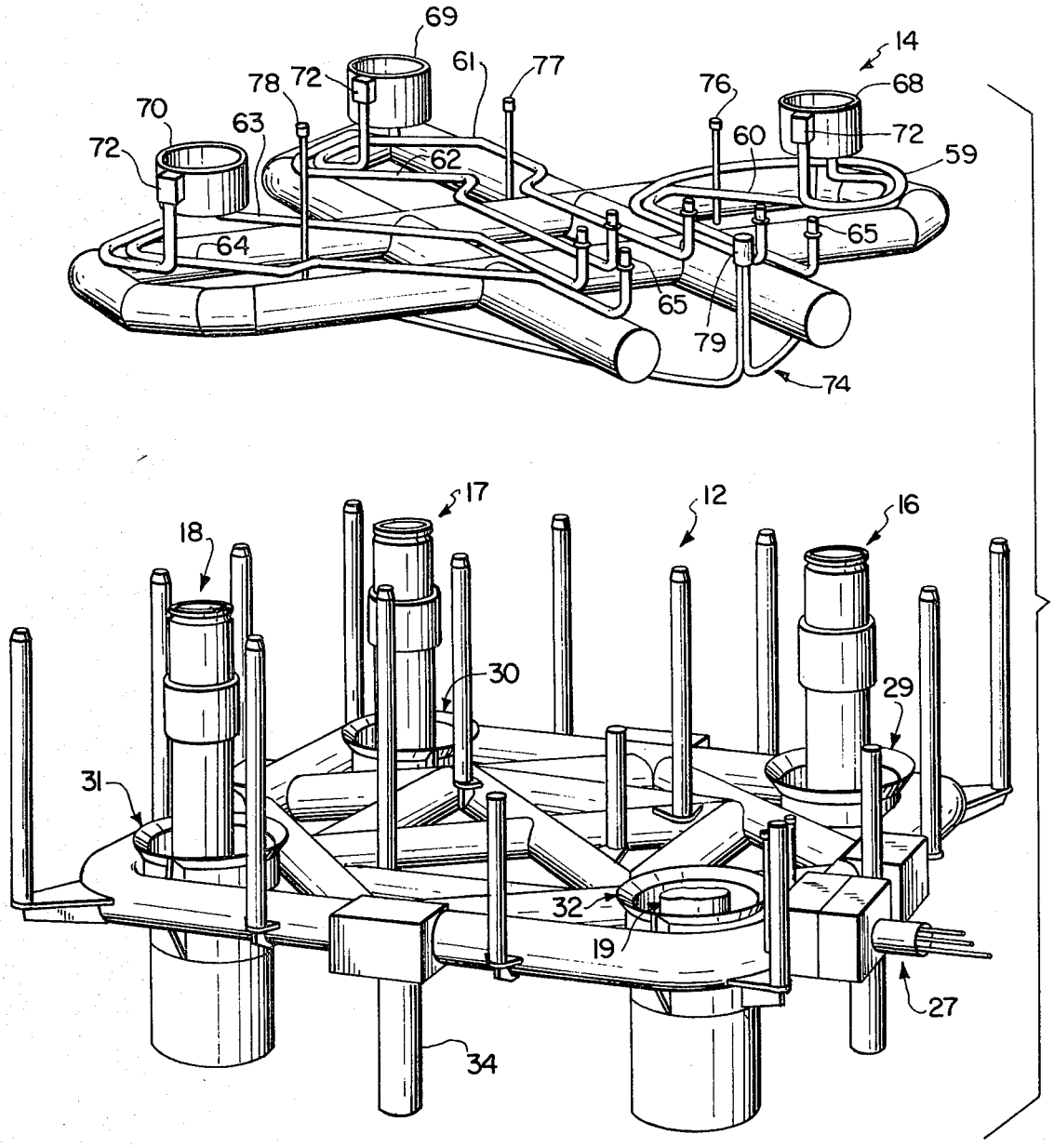
FIG. 2 is a perspective view of the template shown in FIG. 1 and in addition showing four wellheads installed in the four guide sleeves in the template and showing the retrievable piping deck being lowered onto the template.
Figure 4:
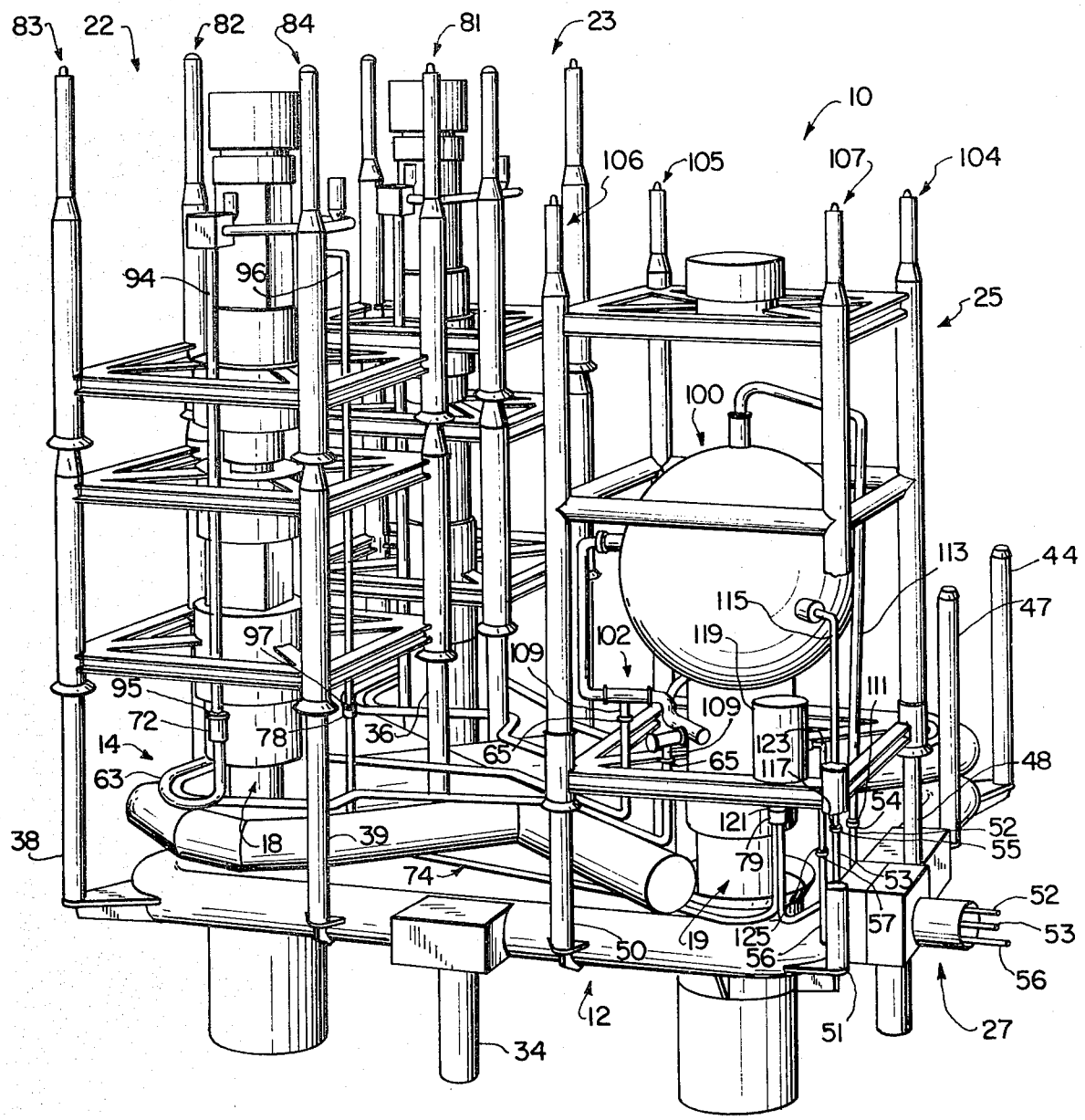

FIG. 3 is a perspective view similar to that shown in FIG. 2 except that the piping deck has been fully landed on the template and a Christmas tree is being lowered towards the template and piping deck; and FIG. 4 is a perspective view similar to that shown in FIG. 3 except that two Christmas trees are completely landed on the template and piping deck and a manifold and separator assembly has also been landed on the template and piping deck.

DETAILED DESCRIPTION OF THE INVENTION

As seen in FIGS. 1–4, the well apparatus 10 comprises a template 12 located on the seabed and having a plurality of wells drilled therethrough, a retrievable piping deck 14 located on the template, four wellheads 16–19 extending above the template, two Christmas trees 22 and 23 connected to two of the wellheads, a manifold-separator assembly 25 also connected to the template, and a main flow line 27 leading from the template to the surface of the sea.

The object of the piping deck is to provide hydraulic and flow lines to interconnect the Christmas trees and deliver well fluid to the surface and hydraulic pressure from the surface. Since the hydraulic and flow lines are directly coupled to the piping deck, if they are damaged the entire piping deck can be retrieved to the surface for repair.

Figure 1:
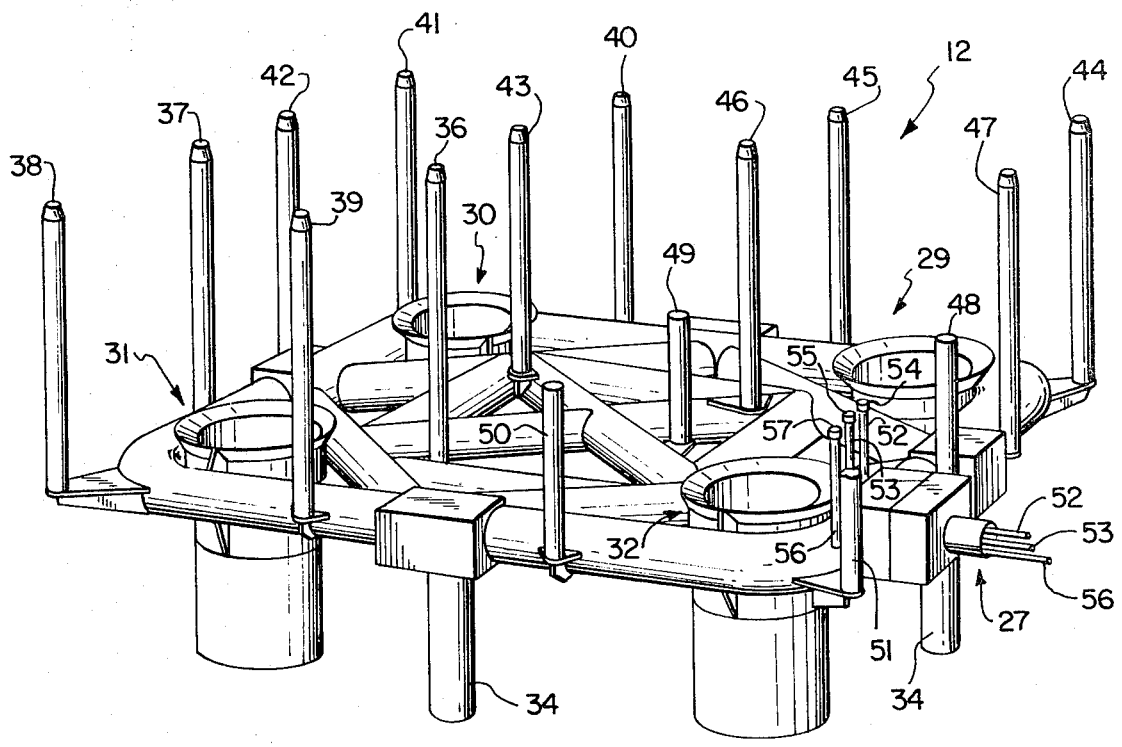
FIG. 1 is a perspective view of a template installed on the seabed in accordance with the invention.

As seen in FIG. 1, the template 12 comprises a plurality of interconnected pipes defining an open lattice, the template having rigidly secured thereto four guide sleeves 29–32 in the four corners. Three wells are drilled through guide sleeves 29–31 and receive surface casings therein in a conventional fashion. Through the fourth guide sleeve 32, only a short well is drilled and filled with surface casing since this guide sleeve will receive the manifold-separator assembly 25 on a "dummy" wellhead.

Before the wells are drilled, the template is levelled using conventional levelling equipment and the template is supported in the levelled position by means of a plurality of piles 34 which are received in the seabed.

Extending rigidly upwardly from the template are a series of guide posts including four guide posts 36–39 arranged in a rectangular array around guide sleeve 31, guide posts 40–43 arranged around guide sleeve 30, and guide posts 44–47 arranged around guide sleeve 29. In addition, there are four shorter guide posts 48–51 arranged around guide sleeve 32 for use with the manifold-separator assembly 25. The other guide posts surrounding guide sleeves 29–31 will be used in conjunction with the Christmas trees to be lowered onto the wellheads.

In the front right hand corner of the template are a pair of vertical flow lines 52 and 53 extending upwardly therefrom, flow line 52 intended to receive the gaseous component of the well fluid from the manifold-separator assembly and flow line 53 intended to receive the liquid component. Flow line 52 has an upwardly facing stab-in connector 54 and flow line 53 also has an upwardly facing stab-in connector 55. Adjacent these flow lines 52 and 53 is a hydraulic line 56 which is vertically oriented and has an upwardly facing stab-in connector 57 at its top for connection with a hydraulic line in the manifold-separator assembly. As seen in FIG. 1, flow lines 52 and 53 as well as hydraulic line 56 extend away from the template and continue to the surface of the sea. Thus, the gaseous and liquid components of the well fluid can reach the surface of the sea via flow lines 52 and 53 and hydraulic fluid under pressure can be delivered to the template via hydraulic line 56.

As seen in FIG. 2, wellheads 16–19 have been installed on the template in the guide sleeves 29–32 in a conventional manner and the piping deck 14 is being lowered down vertical guide lines, not shown, conventionally connected to the guide posts on the template.

The piping deck 14 comprises a plurality of interconnected pipes in an open lattice form which is essentially coextensive with the upper surface of the template 12. As seen in FIG. 2, there are a total of six flow lines 59–64 rigidly coupled horizontally in any suitable manner to the top surface of the piping deck, with two of these flow lines to be associated with each of the three well heads 16–18. Each of the flow lines 59–64 has upwardly extending ends in a vertical orientation with the free ends each having an upwardly facing stab-in connector 65 thereon. The opposite ends of the flow lines are coupled to three locating rings 68–70, with flow lines 59 and 60 being associated with locating ring 68, flow lines 61 and 62 with locating ring 69 and flow lines 63 and 64 with locating ring 70. The ends of each of the flow lines coupled to the locating rings also are vertically extending and are in fluid flow connection with upwardly facing stab-in connectors 72 which are also coupled to each locating ring. Although only one connector 72 is shown for each locating ring, there is a second one for each ring diametrically opposed on the other side which receives the second flow line.

Thus, three assemblies are formed wherein each assembly comprises a locating ring, two upwardly facing connectors coupled thereto, two flow lines in fluid flow communication with the two connectors and a second pair of upwardly facing stab-in connectors on the free ends of the flow lines.

In addition to supporting flow lines 59–64 for well fluid, the piping deck 14 carries a series of hydraulic lines 74 to actuate valves associated with the Christmas trees. As seen in FIG. 2, there are four vertically oriented, upwardly facing stab-in connectors 76–79 on the top of vertical portions of these hydraulic lines, connector 76 being located adjacent locating ring 68, connector 77 adjacent locating ring 69 and connector 78 adjacent locating ring 70. These hydraulic line connectors will engage suitable connectors from hydraulic lines carried by the Christmas trees as will be described in more detail hereinafter. The fourth connector 79 will engage a suitable connector on the manifold-separator assembly.

As seen in FIG. 2, each of the three locator rings is located above an open area of the piping deck and the free ends of the flow lines 59–64 are located in an array spaced about a fourth opening in the piping deck. The hydraulic line connector 79 is also adjacent these free ends of the flow lines, which carry the upwardly facing flow line connectors 65.

As seen in FIG. 3, the piping deck 14 has been lowered and fully landed on the template 12 with the locating rings 68–70 being received over wellheads 16–18. In addition, the guide posts on the template extend through the piping deck and surround their respective wellheads. To rigidly couple the piping deck to the template, conventional hydraulic connectors or latches can be used, for example, hydraulic connections between the locating rings and the wellheads.

In the position shown in FIG. 3, the template guide posts, wellheads, piping deck and flow lines as well as the hydraulic lines are ready to receive the Christmas trees and manifold-separator assembly.

As seen at the top of FIG. 3, Christmas tree 22 comprises four guide post assemblies 81–84 in the four corners thereon, three horizontally oriented support assemblies 85–87 interconnecting the guide post assemblies and a centrally located flow and valve assembly 89 coupled to the support assemblies 85–87. This flow and valve assembly 89 contains the main well flow lines and valves for receiving the well fluid from the wellhead. The bottom most section of the flow and valve assembly has a conventional hydraulic connector to releasably connect the Christmas tree to the wellhead. Inside this flow and valve assembly 89 is a main valve for each of the well flow lines. Externally located on the flow and valve assembly 89 are a pair of wing valves 90, only one being shown, which have a cross over conduit 91 interconnecting these valves with a cross over valve 92 therein. These wing valves and cross over valves regulate the well fluid flow out of the flow and valve assembly 89 and to the flow lines 59–64 on the piping deck. To conduct this well fluid from the Christmas tree to the flow lines to the piping deck, each Christmas tree has a pair of vertically oriented exterior flow lines 94 in fluid flow communication with each of the wing valves 90 and having a downwardly facing stab-in connector 95 at the bottom. Each of these connectors 95 will stab into the upwardly facing connectors 72 carried by each of the locating rings and associated with one of the wellheads. As can be appreciated from FIG. 3, the well fluid flows up from the well formed in the earth, through the surface casing provided therein, through the wellhead and into the flow and valve assembly 89 in the Christmas tree.

Each Christmas tree also carries a vertically oriented exterior hydraulic line 96 having a downwardly facing stab-in connector 97 at the bottom thereof. This hydraulic line 96 provides hydraulic fluid under pressure to operate all of the valves on the Christmas tree including the master valve or valves contained inside the flow and valve assembly 89, the wing valves 90 and the cross over valve 92, as well as any additional valves carried by the Christmas tree.

As indicated in FIG. 3, the downwardly facing connector 97 on the hydraulic line will engage the upwardly facing hydraulic line connector 78 in the piping deck to provide hydraulic fluid communication therebetween.

Referring now to FIG. 4, two Christmas trees 22 and 23 are shown fully landed on the template, wellheads and piping deck with their flow lines and hydraulic lines connected. Thus, regarding wellhead 18 and Christmas tree 22, flow line 94 on the Christmas tree is connected to flow line 63 on the piping deck via the interconnection of connectors 95 and 72. In addition, hydraulic line 96 on the Christmas tree is connected to hydraulic line 74 on the piping deck via a connection of connectors 97 and 78. In this regard, it is seen that the upwardly extending guide posts 36–39 on the template are received in the guide post assemblies 81–84 on the Christmas tree 22.

For reasons of clarity, a third Christmas tree to be associated with wellhead 16 is not shown in FIG. 4, although it could be used, as well as any additional Christmas trees which are deemed necessary and practical.

As seen in FIG. 4, the manifold-separator assembly 25 comprises a separator 100 and a manifold 102. The manifold receives all of the well fluid from the three Christmas trees while the separator separates the gaseous and liquid components of this fluid for separate delivery to the surface.

The manifold-separator assembly 25 is surrounded by a rigid structure similar to that surrounding the Christmas trees including four guide post assemblies 104–107 which are respectively received over the short upwardly extending guide posts 48–51 on the template. In addition, the manifold-separator assembly 25 is secured to the template by means of a suitable hydraulic connector at the bottom thereon engaging the "dummy" wellhead 19 in the corner of the template.

The manifold-separator assembly 25 has six downwardly facing, vertically oriented stab-in connectors 109 extending from suitable flow lines thereon for connection with the upwardly facing connectors 65 on the free ends of the six flow lines 59–64, two of these connectors 109 being shown connected to two connectors 65 in FIG. 4. These connectors 109 are in a vertical orientation arranged in an array to coordinate with the connectors 65 as shown in FIG. 3 for connection by means of downward vertical movement of the manifold-separator assembly.

In addition, the manifold-separator assembly has a downwardly facing stab-in connector 111 on the end of a gas flow line 113 extending from the separator 100 for engagement with upwardly facing stab-in connector 54 on the top of gas flow line 52. A similar liquid flow line 115 extends outwardly and downwardly from the separator and has a downwardly facing vertically oriented stab-in connector 117 at the end thereof for connection with the upwardly facing connector 55 on the liquid flow line 53.

The supporting structure for the manifold-separator assembly also carries a hydraulic fluid manifold 119 which has a downwardly facing stab-in connector 121 thereon for connection with upwardly facing connector 79 on the hydraulic lines 74 on the piping deck.

Extending from the hydraulic fluid manifold 119 is a vertically oriented hydraulic line 123 which has a downwardly facing stab-in connector 125 for connection with upwardly facing connector 57 on the top of hydraulic line 56 which is carried by the template. Thus, hydraulic fluid from the surface is transmitted to the template via hydraulic line 56 at which time it flows through connectors 57 and 125 into hydraulic line 123 carried by the manifold-separator assembly and then into the hydraulic fluid manifold 119. From this manifold the fluid flows through connectors 121 and 79 into the hydraulic lines 74 carried by the piping deck. Along these hydraulic lines the fluid is conducted to the various valves in the Christmas trees via connector 97 and line 96.

OPERATION

In order to drill and complete a subsea well using the retrievable piping deck in accordance with the invention, the first step is to lower the template to the seabed. Then, piles 34 are driven into the seabed and the template is levelled relative to these piles.

Next, a plurality of wells are drilled through the guide sleeves 29–31 with a partial well being drilled through guide sleeve 32. These wells are then provided with surface casing to which the wellheads 16–19 are lowered and installed. Suitable blowout preventors are utilized during this drilling operation.

The levelled template is shown by itself in FIG. 1 while the template receiving the wellheads therein is shown at the bottom of FIG. 2.

Following installation of the wellheads, the retrievable piping deck carrying the preconnected flow lines 59–64, locating rings 68–70 and hydraulic lines 74 is lowered onto the template and rigidly secured thereto.

Next, the Christmas trees and the manifold-separator assembly are lowered to the template as seen in FIGS.

3 and 4. Once lowered onto the template, the flow lines in the Christmas trees and the manifold-separator assembly are connected to the flow lines in the piping deck and flow lines 52 and 53 carried by the template via the stab-in vertically oriented connectors. At the same time, the hydraulic lines on the trees and the manifold-separator assembly are connected to the hydraulic lines on the piping deck and template via the stab-in vertically oriented connectors.

Once this is accomplished, well fluid can flow to the surface via the wellheads, Christmas trees, exterior flow lines 94 on the trees, flow lines 59–64 on the piping deck, the manifold-separator assembly 25, flow lines 113 and 115 and flow lines 52 and 53 in the main flow line 27.

Similarly, hydraulic fluid under pressure can be delivered from the surface via hydraulic line 56, hydraulic line 123, manifold 119, hydraulic lines 74 on the piping deck and hydraulic lines 96 on the Christmas trees to any of the necessary valves associated with the Christmas trees.

Although the piping deck is somewhat protected by the supporting structures surrounding the Christmas trees and the manifold-separator assembly and is coextensive with the template as seen in FIG. 3, any damage to the hydraulic and flow lines on the piping deck can be repaired once the piping deck is retrieved. This is accomplished by removing the trees and manifold-separator assembly to the surface by means of disconnecting any of the connections made in setting up the structure and then raising the piping deck itself for necessary repair. All of this is accomplished without diver intervention and each of the connectors used in the apparatus can be of the type that are connected and disconnected by means of a vertical stab in or pulling apart or can be remotely opened or closed as necessary.

While one advantageous embodiment has been chosen to illustrate the invention, it will be understood by those skilled in the art that various changes and modifications can be made therein without departing from the scope of the invention as defined in the appended claims.

What is claimed is:

1. A subsea well, the combination comprising:

a template installed on the seabed and having a plurality of guide sleeves oriented over a plurality of wells formed in the seabed;

a plurality of wellheads, each installed in one of said guide sleeves;

a retrievable piping deck having a plurality of flow lines coupled thereto and located on the top of said template;

a plurality of Christmas trees, each installed on one of said wellheads;

means, including vertically oriented connectors, for coupling each of said Christmas trees to one of said flow lines;

a fluid manifold installed on said template;

means, including vertically oriented connectors, for coupling each of said flow lines to said manifold; and a main flow line coupled to said manifold and extending from said template to the surface of the sea.

2. A subsea well according to claim 1, wherein said retrievable piping deck further comprises a plurality of locating rings rigidly coupled thereto, each receiving one of said wellheads therein.

3. A subsea well according to claim 2, wherein each of said locating rings is coupled to one of said flow lines and carries one of said vertically oriented connectors for coupling said Christmas trees to said flow lines.

4. A subsea well according to claim 1, and further comprising a separator coupled to said template and in fluid-flow communication with said manifold and said main flow line for separating the gaseous and liquid components received from the wells.

5. A subsea well according to claim 1, and further comprising a plurality of hydraulic lines carried by said piping deck, means, including vertically oriented connectors, for coupling each of said Christmas trees to one of said hydraulic lines, and means for supplying said hydraulic lines with fluid under pressure from the surface of the sea.

6. A subsea well according to claim 1, wherein each of said flow lines coupled to said piping deck have upwardly directed ends.

7. A subsea well according to claim 1, wherein said main flow line is coupled to said manifold by a downwardly facing connector on said manifold and an upwardly facing connector carried by said template.

8. A method of drilling and completing a subsea well, comprising the steps of lowering a template to the seabed, drilling a plurality of wells in the seabed through the template, lowering a plurality of wellheads to the template and installing the wellheads over the wells, lowering a retrievable piping deck onto the template, the piping deck carrying flow lines with upwardly facing connectors thereon, lowering a plurality of Christmas trees to the template, each having a flow line with a downwardly facing connector thereon, coupling the piping deck flow lines and Christmas tree flow lines via their connectors by downward movement of the Christmas trees onto the wellheads, and conducting well fluid from the wells, through the wellheads, through the Christmas trees, and through the connected Christmas tree and piping deck flow lines to the surface of the sea.

9. A method according to claim 8, wherein the conducting step is preceded by the steps of lowering a manifold to the template, the manifold having a plurality of downwardly facing connectors thereon, and coupling the manifold downwardly facing connectors to the upwardly facing connectors on the piping deck flow lines by downward movement of the manifold, the conducting step including conducting well fluid from the piping deck flow lines, through the manifold and to the surface of the sea.

10. A method according to claim 9, wherein the template carries an upwardly facing connector, and the conducting step includes coupling a manifold downwardly facing connector to the upwardly facing connector on the template.

11. A method according to claim 8, wherein the piping deck carries hydraulic lines with upwardly facing connectors thereon, the Christmas trees carry hydraulic lines with downwardly facing connectors thereon, the step of coupling the piping deck flow lines and Christmas tree flow lines includes coupling the piping deck hydraulic lines and Christmas tree hydraulic lines via their connectors by downward movement of the Christmas trees onto the wellheads, and the conducting step includes conducting hydraulic fluid under pressure from the surface of the sea to the hydraulic lines on the piping deck.

12. A method according to claim 11, wherein the template carries a hydraulic line with an upwardly facing connector, the conducting hydraulic fluid step includes lowering a manifold to the template, the manifold having a pair of hydraulic lines with a pair of downwardly facing connectors, and coupling the pair of manifold hydraulic line downwardly facing connectors to the upwardly facing connector on the template hydraulic line and one of the upwardly facing connectors on one of the piping deck hydraulic lines via downward movement of the manifold.

* * * * *